US005393050A

United States Patent [19]

Lloyd

[11] Patent Number: 5,393,050

[45] Date of Patent: Feb. 28, 1995

[54] BALL STRIKING PRACTICE DEVICE

[76] Inventor: Anthony L. Lloyd, #3 7231 Moffatt Road, Richmond, B.C. V6Y 1X9, Canada

[21] Appl. No.: 157,324

[22] Filed: Nov. 26, 1993

[51] Int. Cl.[6] ..... A63B 61/00

[52] U.S. Cl. ..... 273/29 A; 273/26 R

[58] Field of Search ..... 273/26 R, 29 A, 184 B, 273/185 D, 196, 197 A, 200 B, 58 C; 482/83, 84, 85, 86, 87, 88, 89, 90

[56] References Cited

U.S. PATENT DOCUMENTS

| | | | |
|---|---|---|---|
| 628,236 | 7/1899 | Warren | 273/185 D |
| 1,680,897 | 8/1928 | Matteson | 273/185 D |
| 2,897,674 | 8/1959 | McNeill | 273/184 B |
| 4,204,678 | 5/1980 | Weis | 273/29 A |
| 4,258,916 | 3/1981 | Beam | 273/26 R |
| 4,989,867 | 2/1991 | Herrick | 273/29 A |

*Primary Examiner*—Theatrice Brown
*Attorney, Agent, or Firm*—Burke-Robertson

[57] ABSTRACT

A ball striking practice device comprising an elongated base having an upper surface, longitudinal groove in the upper surface, a post having an end pivotally secured to the base at a location in the groove spaced below the upper surface for pivotal movement in its longitudinal direction between a first, starting position and a second, remote position, and means for supporting a ball to be hit at the other end of the post. Resilient stop means are releasably secured on the upper surface in positions across the groove to define the starting and remote positions of the post. A biasing means is associated with the base and the post yieldably to urge the post towards starting position.

18 Claims, 5 Drawing Sheets

BALL STRIKING PRACTICE DEVICE

FIELD OF THE INVENTION

The present invention relates to a ball striking practice device and more particularly to a device that provides a moving but secured ball to facilitate the simulation of tennis or other play in a manner that permits the solo practice of footwork, timing and strokes in a confined area. While the present invention relates particularly to such a device for simulation of tennis play, it also envisages such a device which is adaptable to other sports and activities in which a ball is to be struck.

BACKGROUND OF THE INVENTION

With respect to tennis, up the present time tennis players have been limited to three methods of solo practice, which, for a variety of reasons, do not meet their needs:

(1) The ball machine. This an excellent method but requires very costly equipment which pneumatically powers balls, in sequence, to the player on a full size court. A ball machine is not within the means of the average player for regular practice sessions.

(2) False walls or netted frames to rebound a struck ball back to the player. The space requirement of the practice area limits availability. In addition to this, the average player cannot maintain the repetitive trajectory that is essential to a consistent stroke that will build muscle memory.

(3) A motionless ball sitting in an apparatus ready to be struck by a racket. This does provide practice for the basic mechanics of a tennis stroke. However ninety percent of miss-hit strokes are related to footwork and the inability of a player to time the racket movement to coincide exactly with ball speed, so that the ball will be struck at the exact instant required for a perfect return.

Ball striking practice devices are well known in the prior art. Of particular reference to the present invention are U.S. Pat. No. 2,713,487 of Jaediker issued Jul. 19, 1955 and U.S. Pat. No. 4,089,521 of Berst et al issued May 16, 1978. Both of these references teach tennis practice devices comprising base-mounted pivoting posts which support tennis balls at their free ends, and in which the posts are biased to return to an initial position when the ball has been hit causing the posts to pivot away from that position. Such constructions have tended to be large and unwieldy, with heavily weighted bases to withstand the impact of the ball being hit and the pivoting motion of the post. As well, the positioning and amplitude of the post remains fixed, dictated by the construction of the device.

Other references of general background interest describing and illustrating ball striking practice devices include U.S. Pat. No. 1,670,174 of Richards issued Jul. 31, 1928, U.S. Pat. No. 2,578,313 of Moseley issued Dec. 11, 1951, U.S. Pat. No. 3,876,203 of Gold issued Apr. 8, 1975, U.S. Pat. No. 3,794,320 of Salmont issued Feb. 26, 1974, U.S. Pat. No. 3,924,853 of Schleeger issued Dec. 9, 1975, U.S. Pat. No. 4,204,678 of Weis issued May 27, 1980, U.S. Pat. No. 4,417,730 of Weiner issued Nov. 29, 1983, U.S. Pat. No. 4,508,339 of Llewellyn , U.S. Pat. No. 4,508,340 of Liao issued Apr. 2, 1985, U.S. Pat. No. 4,531,734 of Herrick issued Jul. 30, 1985.

SUMMARY OF THE INVENTION

It is an object of the present invention to provide a lightweight, portable, but stabilized ball striking practice device. It is a further object of the present invention to provide such a device which will enable striking of the ball while in motion, to enhance hand-eye co-ordination. It is a further object of the present invention to provide such a device which will be readily adaptable to simulate game or practice conditions.

In accordance with the present invention, a ball striking practice device is provided of the type comprising an elongated base having an upper surface, a post having an end pivotally secured to the base for pivotal movement in its longitudinal direction between a first, starting position and a second, remote position, means for supporting a ball to be hit at the other end of the post and biasing means mechanically associated with the base and the post yieldably to urge the post towards the starting position. In accordance with the invention, an improvement in such a device is provided characterized in that a longitudinal groove is provided in the upper surface. The post is pivotally secured to the base at a location in the groove spaced below the upper surface. Resilient stop means are provided releasably securable on the upper surface in positions across the groove to define the starting and remote positions of the post.

In a preferred embodiment the stop means are releasably securable at desired locations on the upper surface by means of hook and pile fastener means or by being releasably fitted into one of a series of grooves in the upper surface.

As well, the device is preferably provided with stabilizing legs outwardly extendable from stowed position within the base, longitudinally beyond an end of the base proximal to the post's remote position, the legs when in extended position to stabilize the device against movement of the base during use. The biasing means preferably comprises an elastic cord, one end of which is secured to a portion of the post near its end which is pivotally secured to the base and the other end of which is releasably securable to the base.

The device according to the present invention is of simply, lightweight construction. In its preferred embodiment, it is, on the one hand both collapsible and portable, and on the other, with stabilizing legs outwardly extended from the base, effectively stabilized during use. By appropriately selecting the stop locations, as will be described in more detail hereinafter, the initial positioning of the post, and its amplitude and speed during use of the device may be readily controlled.

BRIEF DESCRIPTION OF THE DRAWINGS

These and other objects and advantages of the invention will become apparent upon reading the following detailed description and upon referring to the drawings in which.

Figure 1:
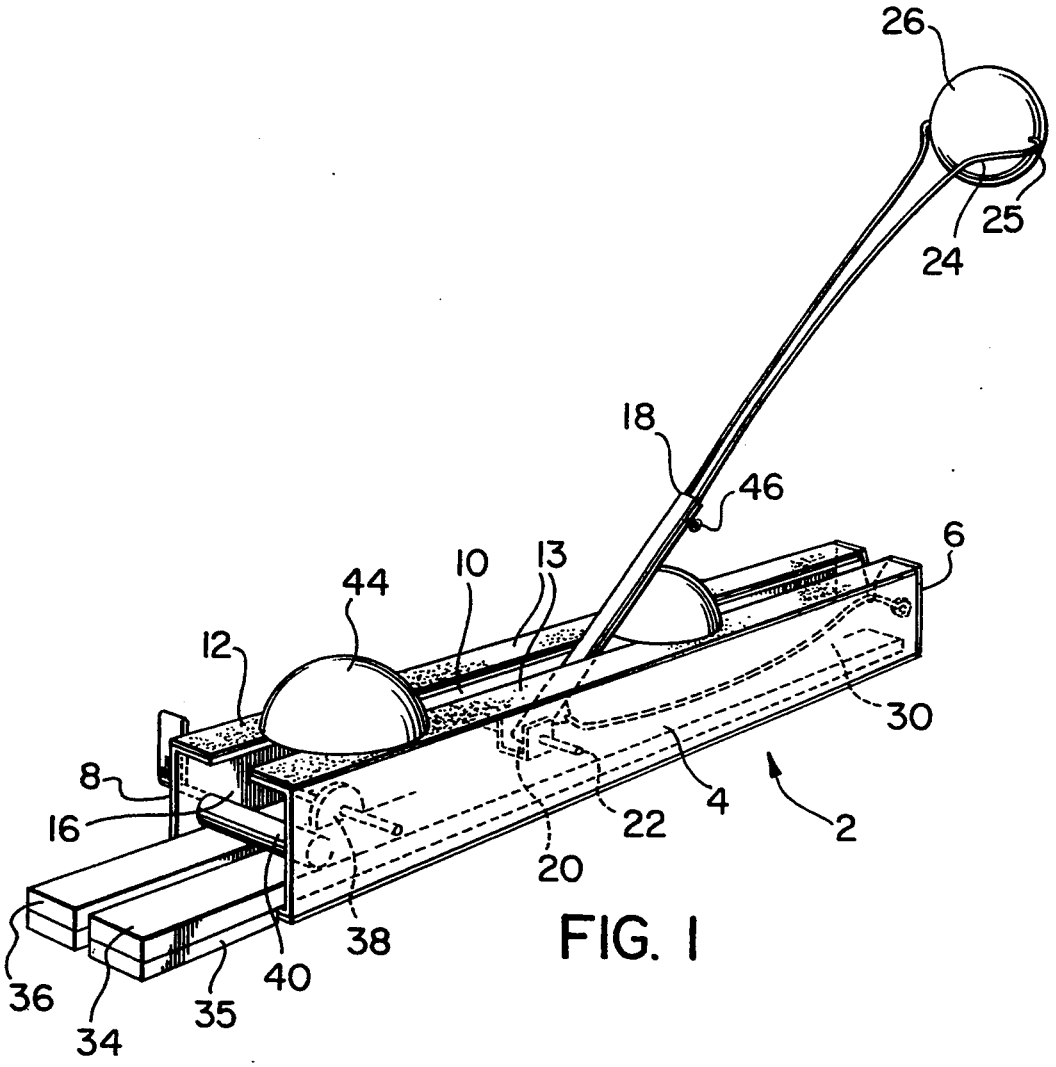
FIG. 1 is a perspective view of a ball striking practice device, particularly adapted for tennis.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings similar features have been given similar references numerals.

Turning to FIG. 1, there is illustrated a ball striking practice device 2, particularly adapted to tennis, in accordance with the present invention. Device 2 comprises a base or frame 4 having a proximal end 6 and remote end 8, with an elongated slot 10 extending end to end in the upper surface 12 of frame 4. Upper surface 12 is preferably covered with either the hook or pile portion 13 of a velcro fastening means. A cavity 16, the function of which will be described in more detail hereinafter, is provided within frame 4.

Figure 6A:
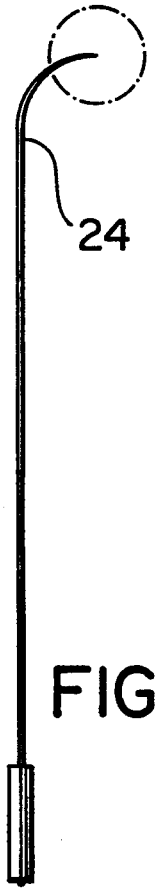
FIG. 6*a* and 6*b* are respective side and front views of an example embodiment of the upper portion of a flexible post in accordance with the present invention.
Figure 6B:
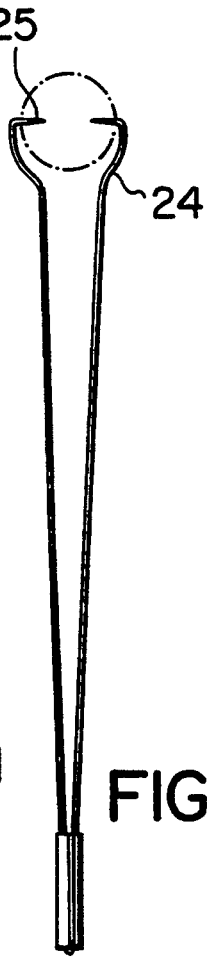

An elongated post 18 made of a resilient material such as spring steel is provided, with its lower end 20 pivotally secured by means of pivot pin 22 to elongated frame 4, so that post 18 will pivot in the longitudinal direction within portions of slot 10. A preferred construction of the upper portion of post 18 is illustrated in FIGS. 6*a* and 6*b*, where it will be seen that the upper end 24 is curved out of alignment with the remainder of post 18, upper end 18 terminating in an oar lock construction 25 as illustrated. Tennis ball 26 is pivotally secured within oar lock construction 25. It can be seen, with this arrangement for holding tennis ball 26 in place, with post 18 positioned so that the axis of rotation of ball 26 is perpendicular to the direction of movement of post 18 and with upper end 24 being curved out of alignment with the remaining portion of post 18, a fore spin or a back spin, as desired, can be placed on the ball when struck with a tennis racket.

Figure 2:
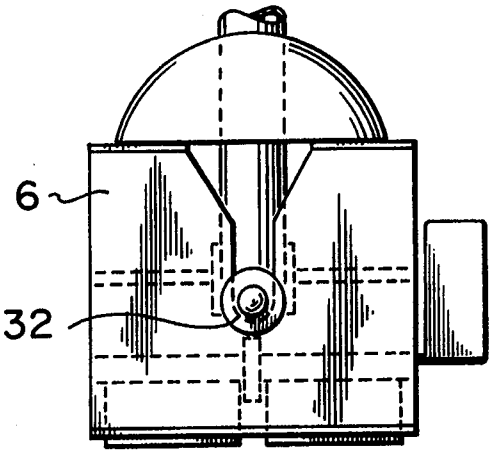
FIG. 2 is an elevation view from the right end, of the device of FIG. 1.

To ensure that post 18 returns to its initial, starting position after ball 26 has been hit, a bungee cord 30 or the like is provided, with one end secured to a lower portion of post 18 and the other end releasably securable in a jamb cleat 32 (FIG. 2) fitted on end 6, below upper surface 12, of frame 4. It will be understood that the tension or bias holding post 18 in its initial position, which must be overcome when ball 26 is hit to cause post 18 to pivot, is thereby adjustable simply by changing the portion of bungee cord 30 that is wedged into jamb cleat 32.

Figure 3:
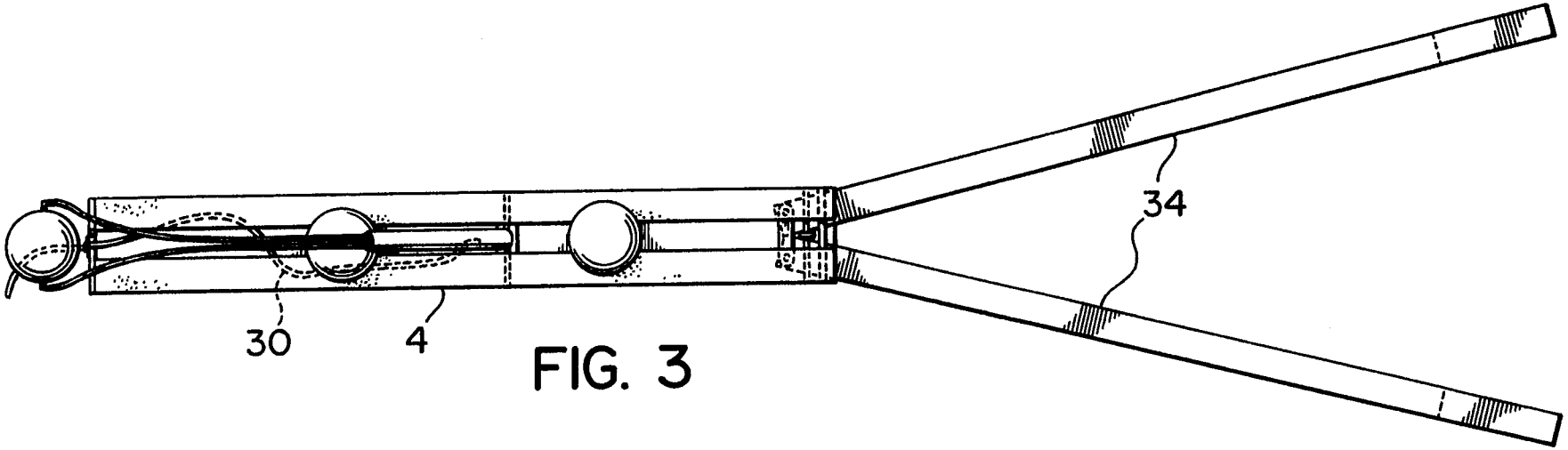
FIG. 3 is a plan view of the base of the device of FIG. 1, from the top, with its stabilizing legs extended.

To provide stability for device 2 during use, a pair of stabilizing legs 34 are telescopically fitted within the cavity of frame 4, outwardly extending from remote end 8 as illustrated. Anti slip material 35 such as rubber may be provided as illustrated (FIG. 1) at the external ends 36 of legs 34. Stabilizer legs 34 are constructed so as to become spread, by spreader washer 38 secured within cavity 16 between legs 34, into operative position as illustrated in FIG. 3. In that position a locking bar 40, transversely fitted across cavity 16 is illustrated, may be turned to hold the legs in operative position. Retraction of legs 34 into parallel, storage position within cavity 16 may be accomplished when locking bar 40 is turned into release position.

Releasably securable to upper surface 12, in a position bridging slot 10 are a proximal stop 42 and a remote stop 44. The stops are made of flexible resilient material such as rubber, and constructed so as to define the limits of pivoting, in the proximal and remote directions, of post 18. The stops are provided with lower, flat surfaces on which the mating hook or pile material 13, to that which has been used on upper surface 12, is secured, so that the stops may be readily secured in place or removed for repositioning in other places on upper surface 12.

Figure 4:
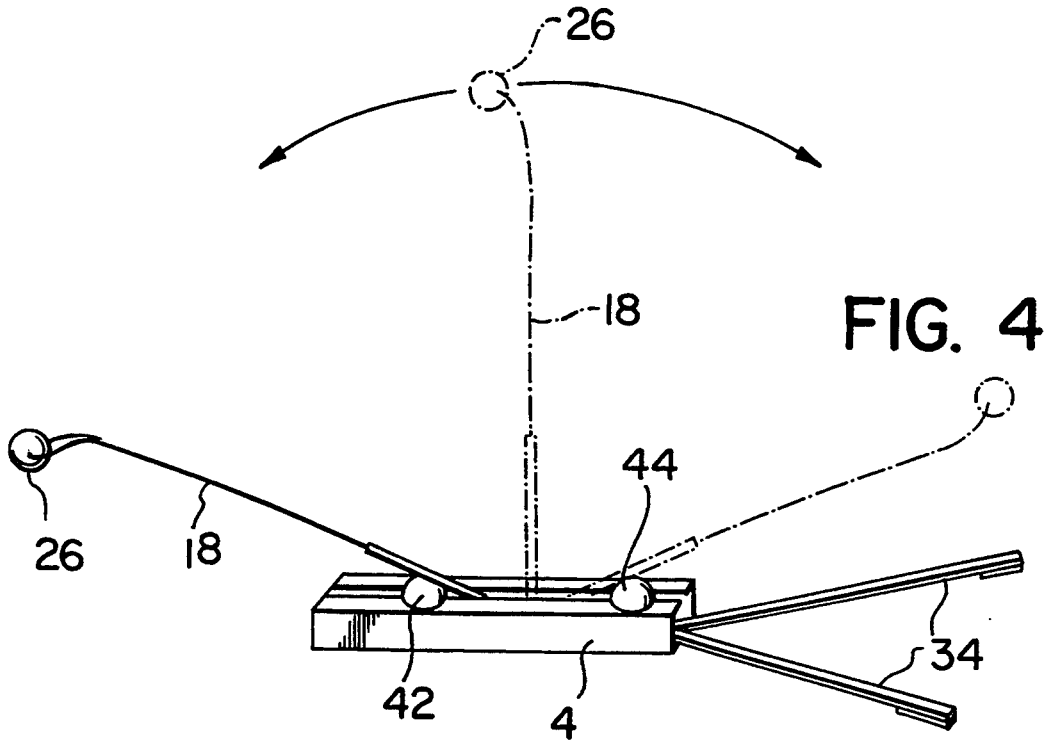
FIGS. 4 and 5 are schematic side views of the device of FIG. 1 with the stops differently situated, illustrating different positions and motions of the post during use of the device.
Figure 5:
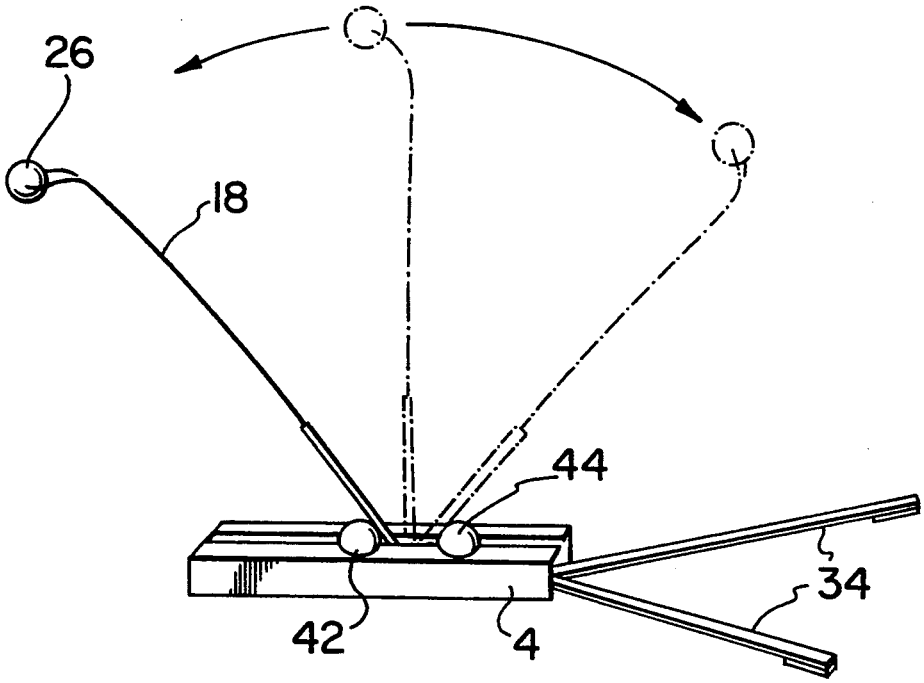

It will be understood that elongated post 18 may have its upper end 24 releasably secured to the remainder of post 16 e.g. pin 46, and/or secured thereto in a manner in which the total height of post 18 may be adjusted using conventional means. In operation, the stops 42 and 44 may be positioned for a wide pivoting action (FIG. 4) or a narrower pivoting action (FIG. 5) depending on the particular tennis ball striking exercise desire. Stabilizing legs 34 are withdrawn from cavity 16 and secured in spread position (as illustrated in FIG. 3), using locking bar 40. The tension on bungee cord 30 is appropriately arranged using jam cleat 32. The device is then ready for operation.

Figure 7:
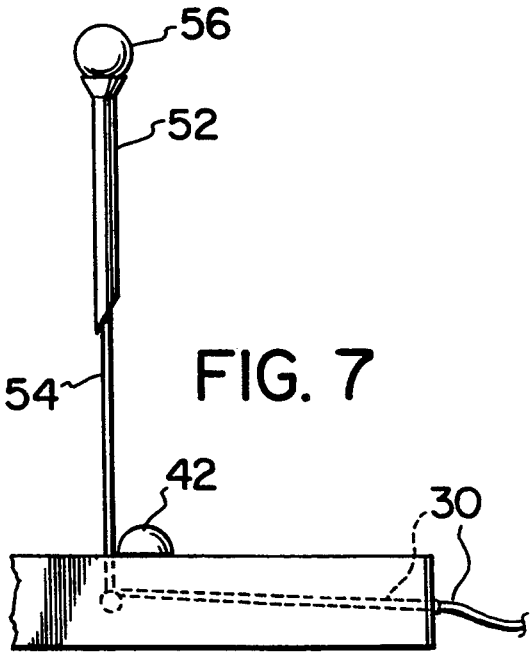
FIG. 7 is a side, schematic view of a portion of the device with the post adapted for a baseball batting practice.

When the device is not in use, pivot pin 22, which is preferably releasable, may be withdrawn so that post 18 can be removed from its position in slot 10, and stored for example within cavity 16. Telescopic legs 34 are retracted into cavity 16 as well for storage.

Where upper end 24 of post 16 is releasably secured to the lower portion of elongated post 18, the device may be adapted to another activity, by using an appropriate adaptor such as, for example, the baseball adapter 52 illustrated in FIG. 7. That adapter is appropriately secured to the lower portion 54 of post 18, and its upper end forms a cradle 56 for a baseball, which for example may be unattached. A person with a bat then merely hits the ball off of the cradle. Stop 42 is arranged so that the ball will be at an appropriate height. It will be readily apparent that other adaptions of this device for example to hold tether balls, racket balls or the like for practice may be provided.

Figure 8:
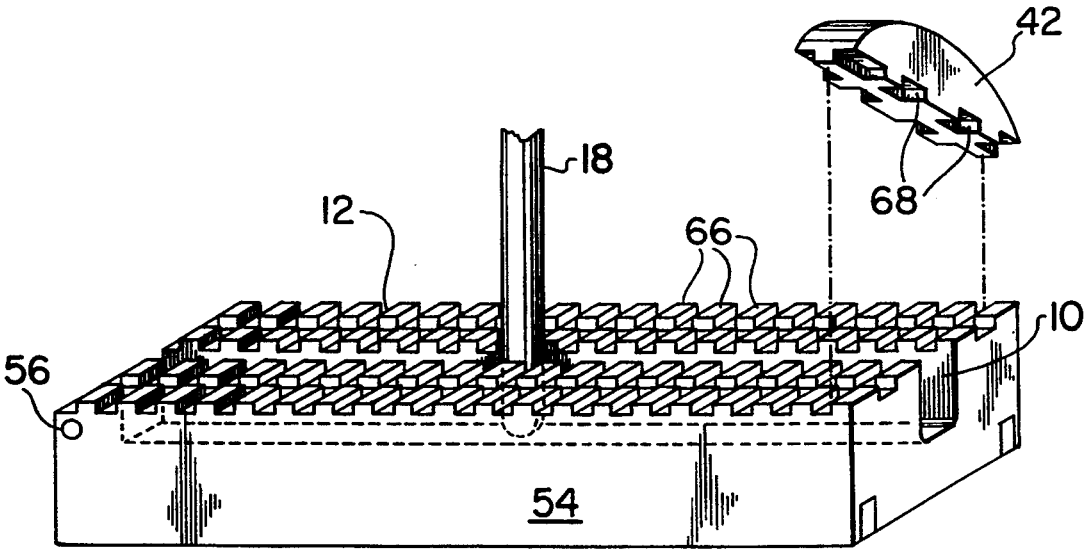
FIG. 8 is a partial view in perspective of an alternative of construction of a ball striking practice device according to the present invention.
Figure 9:
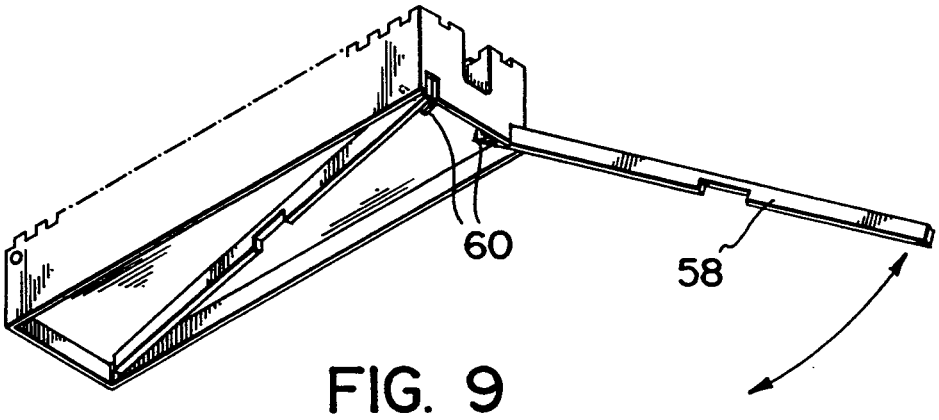
FIG. 9 is a perspective view, from the bottom, of the frame of FIG. 8.

In the alternative embodiment of frame construction illustrated in FIGS. 8 and 9, the frame 54 is for example made of low moulded plastic, with elongated slot 10. An opening 56 to a chamber within frame 54 enables that frame to be filled with water or sand, for purposes of waiting.

The stabilizing legs 58 are hinged at pivot 60 to the bottom of frame 54 as illustrated, to be stowed into an appropriate recess in the bottom of frame 54 as illustrated when not in use and to be swung out (phantom FIG. 9) for use.

In this alternative embodiment instead of a hook and pile fastener means for securing stops 2 and 44 to the upper surface of base 4, that upper surface 12 is provided with notches and projections 66 as illustrated, to frictionally engage with mating notches and projection 68, in the lower surface of the stop 42 or 44, as illustrated. Thus stops 42 and 44 may be simply removed from engagement on upper surface 12 and secured at another desired location on that surface, to alter the pivoting motion of the post 18.

Thus it is apparent that there has been provided in accordance with the invention a ball striking practice device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a ball striking practice device comprising an elongated base having an upper surface, a ball-supporting post having one end thereof pivotally secured to the base for pivotal movement in a longitudinal direction with respect to the base between a first, starting position and a second, remote position, a ball attached to for supporting the other end of the post, biasing means mechanically associated with the base and the post yieldably to urge the post towards the starting position, the improvement characterized in that a longitudinal groove is provided in the upper surface, the post is pivotally secured to the base at a location in the groove spaced below the upper surface, and resilient stop means are provided releasably securable on the upper surface in positions across the groove to define the starting and remote positions of the post.

2. A device according to claim 1 wherein, to the upper surface of the base is secured either the hook or pile component of a hook and pile fastener, and the other of these components is secured to a confronting surface of each of the stop means to enable releasable securing of the stop means at desired locations on the upper surface.

3. A device according to claim 1 further provided with stabilizing legs slidably extendable from stowed position within the base, longitudinally beyond an end of the base proximal to the post's remote position, the legs securable in extended position to stabilize the device against movement of the base during use.

4. A device according to claim 3 wherein means are provided to simultaneously spread the stabilizing legs as they are extended from the base.

5. A device according to claim 3 further comprising means to collapse and secure the post in a cavity within the base.

6. A device according to claim 3 wherein the post is of resilient material.

7. A device according to claim 5 wherein the post is constructed of carbon spring steel, with its upper end curved out of alignment with the rest of the post.

8. A device according to claim 6 wherein the ball is a tennis ball, and the upper end of the post is provided with means to secure the tennis ball for rotation freely about an axis for simulation of a normal racket contact response.

9. A device according to claim 6 wherein the post comprises an upper part and a lower part, the upper part releasably secured to the lower part.

10. A device according to claim 9 wherein the biasing means comprises an elastic cord, one end of which is secured to a portion of the post near its end which is pivotally secured to the base and the other end of which is releasably securable to the base.

11. A device according to claim 3 wherein, to the upper surface of the base is secured either the hook or pile component of a hook and pile fastener, and the other of these components is secured to a confronting surface of each of the stop means to enable releasable securing of the stop means at desired locations on the upper surface.

12. A device according to claim 1 wherein the biasing means comprises an elastic cord, one end of which is secured to a portion of the post near the end of the post which is pivotally secured to the base and the other end of which cord is releasably securable to the base.

13. A device according to claim 12 wherein a jamb cleat is secured to the base at the end proximal to the starting position of the post, to releasably receive therein a portion of the elastic cord.

14. A device according to claim 1 wherein grooves and projections are provided along the upper surface of the base, to frictionally engage with mating grooves and projections on a lower surface of each of the stop means.

15. A device according to claim 1 further provided with stabilizing legs pivotally secured to a lower surface of the base, each to pivot between a stowed position secured under the base and an extended position projecting longitudinally beyond an end of the base proximal to the post's remote position.

16. In a ball striking practice device comprising an elongated base having an upper surface, a ball-supporting post having one end thereof pivotally secured to the base for pivotal movement in a longitudinal direction with respect to the base between a first, starting position and a second, remote position, a ball attached to the other end of the post, biasing means mechanically associated with the base and the post yieldably to urge the post towards the starting position, the improvement characterized in that a longitudinal groove is provided in the upper surface, the post is pivotally secured to the base at a location in the groove spaced below the upper surface, resilient stop means are releasably secured to the upper surface in positions across the groove by hook and pile fastener means to define the starting and remote positions of the post, stabilizing legs are slidably extendable from stowed position within the base, longitudinally beyond an end of the base proximal to the post's remote position, the legs securable in extended position to stabilize the device against movement of the base during use.

17. A device according to claim 16 wherein means are provided for collapsing and securing the post within the cavity.

18. A device according to claim 16 wherein the biasing means comprises an elastic cord, one end of which is secured to a portion of the post near the end of the post which is pivotally secured to the base and the other end of which cord is releasably securable to the base.

* * * * *